US005517908A

United States Patent [19]

Stout

[11] Patent Number: 5,517,908

[45] Date of Patent: May 21, 1996

[54] BALER FOR COMPACTING AND THEN LOADING HAZARDOUS WASTE INTO CARTONS

[76] Inventor: Robert P. Stout, 570 Commonwealth Pla., Sarasota, Fla. 34242

[21] Appl. No.: 280,058

[22] Filed: Jul. 25, 1994

[51] Int. Cl.[6] ..... B30B 9/30

[52] U.S. Cl. ..... 100/90; 53/529; 100/3; 100/218; 100/229 A; 100/246

[58] Field of Search ..... 100/3, 7, 90, 218, 100/229 A, 246, 247, 249, 251; 53/529

[56] References Cited

U.S. PATENT DOCUMENTS

| | | | |
|---|---|---|---|
| 3,405,744 | 10/1968 | Bowman | 100/246 |
| 3,469,530 | 9/1969 | Walker et al. | 100/255 |
| 3,496,862 | 2/1970 | Sowerby | 100/218 |
| 3,557,683 | 1/1971 | Boyd | 100/218 |
| 3,585,925 | 6/1971 | Fox | 100/218 |
| 3,677,175 | 7/1972 | Marvin | 100/218 |
| 3,882,771 | 5/1975 | Frohbieter | 100/246 |
| 4,463,669 | 8/1984 | Van Doorn et al. | 100/246 |
| 5,012,732 | 5/1991 | Fox | 100/229 A |
| 5,044,271 | 9/1991 | Robbins et al. | 100/255 |

FOREIGN PATENT DOCUMENTS

| | | | |
|---|---|---|---|
| 103420 | 5/1874 | France | 100/247 |
| 63-137600 | 6/1988 | Japan | 100/902 |
| 8200548 | 9/1983 | Netherlands | 1000 229 A |
| 1237580 | 6/1986 | U.S.S.R. | 100/229 A |
| 1509968 | 5/1978 | United Kingdom | 100/218 |

*Primary Examiner*—Stephen F. Gerrity
*Attorney, Agent, or Firm*—Ferris Stout

[57] ABSTRACT

The baler embodies false side walls which act as spacers in the bale chamber while the bale is completed. After completion, dogs on the platen engage the false side walls; they are raised by the ascending platen, and retained in the raised position by dogs on the baler side walls while the platen descends and compresses the bale. The bale is wired to the platen, which, rising, lifts the bale out of the bale chamber and allows a carton to be inserted in the (opened) bale chamber. The platen, descending again, lowers the bale into the carton; the lifting wires are cut, the platen rises, and the carton is sealed and extracted from the bale chamber.

6 Claims, 2 Drawing Sheets

BALER FOR COMPACTING AND THEN LOADING HAZARDOUS WASTE INTO CARTONS

BACKGROUND OF THE INVENTION

1. Field of the Invention

The invention is in the fields of comercial balers, and also in the field of solid hazardous waste disposal.

2. Definitions

In what follows, the following terms have these meanings:

Hazardous Waste is solid, hazardous waste of the type which must be disposed of in corrugated cartons approved by the Department of Transportation. Such a carton is referred to in the industry as a "Cecos Pack". It is made of tri-walled corrugated board, 36 inches on a side, lined with six mil polyethylene film. When full, the polyethylene liner is sealed, the carton is closed and sealed with duct tape, and is manifested in detail, ready for shipment to an authorized landfill.

Carton refers to a carton specified for Hazardous Waste by the DOT as above.

Hazbaler in what follows refers to a vertically disposed, manually fed industrial baler modified to load cartons with dense bales of Hazardous Waste weighing 350 to 500 pounds. It is designed to accomplish this in an environment of negative air flow.

THE PRIOR ART

Cartons (as defined) are expensive and filling them with Hazardous Waste, by hand or conveyor, as presently done, is time and labor consuming. Cardboard boxes, plastic pails, and the like, waste much of the carton's capacity; transportation is charged per carton, not per pound. If the Hazardous Waste were to be first compacted, as by baling it, before it is loaded into the carton, the carton's capacity would be increased by as much as sixfold, and substantial savings thereby realized.

Vertical balers have been designed to compress waste into cartons. For example Bowman (U.S. Pat. No. 3,405,744) provides a baler with retractable sidewalls which, extending into a carton, support the sidewise thrust of the baler's platen during its compression stroke, and then withdraws the sidewalls when the carton is full. The Bowman baler is unsuitable for Hazardous Wastes, however, for several reasons: The compacted waste in the carton will reexpand to some extent when the platen and sidewalls are retracted, making necessary manual contact with the contents. Moreover after the sidewalls are retracted, compaction is limited to the strength of the carton; sharp objects—collapsed pails, broken strapping, and the like—are likely to tear the liner or pierce the carton itself as its contents try to expand. Since with the Bowman baler the sidewalls always retract when the platen rises, the Bowman baler is limited to a single compression stroke; but a heterogeneous load requires multiple compression strokes with intermittent loading. Finally, containment of the process within a negative airflow environment would be difficult if not impossible.

A need exists therefore for a baler which will make a tight bale of heterogeneous hazardous Wastes which is conventionally secured with binding wires, and insert the finished bale into a carton.

SUMMARY OF THE INVENTION

An object of the invention is to provide means for making a bale of Hazardous Waste, elevating the finished bale, and lowering the bale into a carton.

A further object of the invention is provide means for making a bale of Hazardous Waste and loading the bale into a carton in an environment of negative airflow.

To attain these objectives, two criteria must be met. The finished bale must be elevated in the baler to allow positioning of a carton beneath the bale, so that the bale can be lowered into the carton; and, the bale must be made smaller than the bale chamber in which it was made, to allow clearance around its periphery for the walls of the carton.

These objectives are attained with the Hazbaler. The Hazbaler provides retractable sidewalls within which a bale of Hazardous Waste is formed and tied with wires. Grooves on the upper surface of the Hazbaler platen accomodate lifting wires. After the bale is finished and the lifting wires secured, the platen rises slightly, relieving pressure on the bale; a positioning device moves the bale forward slightly; and the platen rises to its upper limit, lifting with it the retractable sidewalls and the new bale of Hazardous Waste. The sidewalls latch in the retracted position. The operator positions an open carton beneath the bale, and presses a control. The platen descends, inserting the bale in the carton. The operator cuts the lifting wires (leaving them in the carton), and presses another control. The platen rises again; the operator removes and seals the carton with the bale in it.

The Hazbaler may be enclosed in a negative airflow environment with limited access for manipulating the bale and the carton.

Thus the Hazbaler enables inserting into a carton, in a negative airlow environment, many times the weight of uncompacted Hazardous Waste that it would otherwise accomodate.

DESCRIPTION OF A PREFERRED EMBODIMENT

Figure 2:
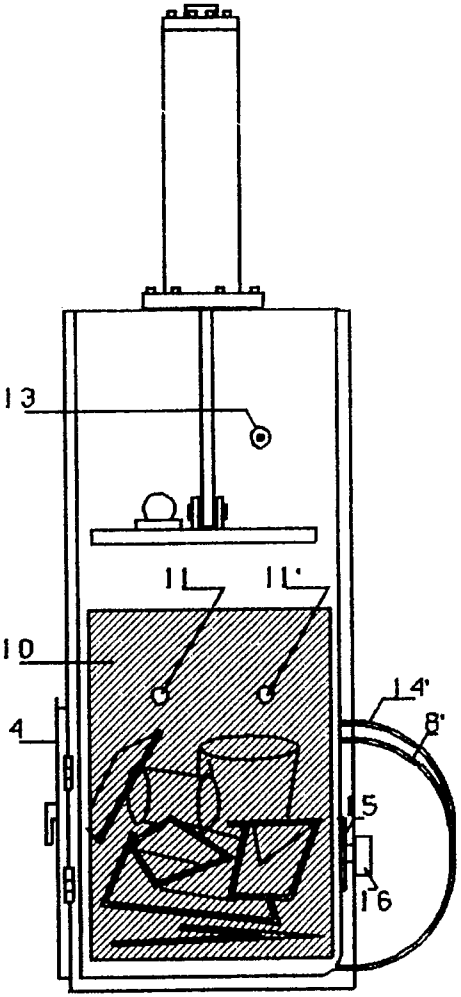
FIG. 2 is a schematic sketch in cross section through the side of the baler of FIG. 1.
Figure 1:
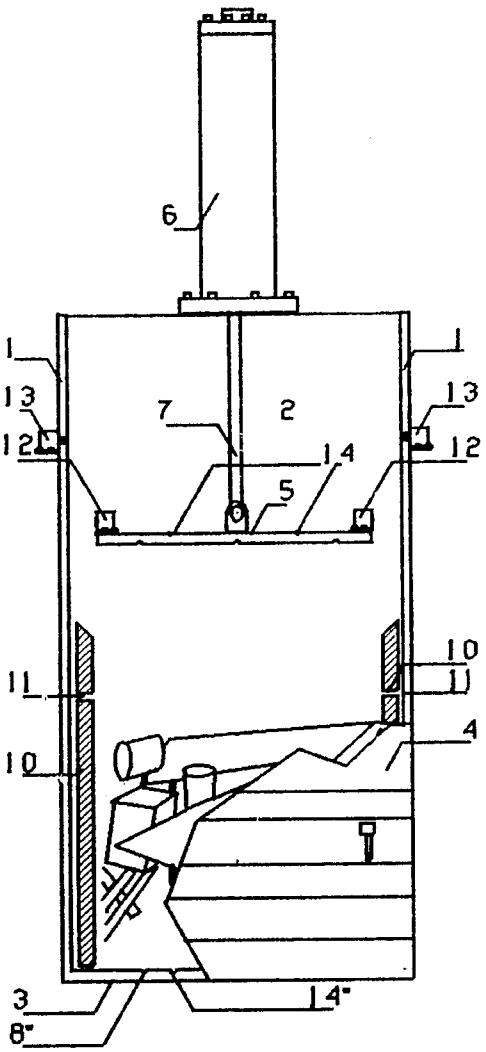
FIG. 1 is a schematic sketch in cross section through the front of a vertical baler modified for baling and packaging hazardous waste.

FIGS. 1 and 2 illustrate schematically the operative parts of a vertical baler adapted for baling and packaging hazardous waste in cartons. The view is of the baler positioned to start a new baling sequence.

As in a conventional vertical baler (see FIG. 1), sidewalls 1, the back wall of the baler 2, the baler floor 3, and the door 4, shown cut away, and the platen 5 define a cavity—the bale chamber—in which the bale of waste is formed. The platen, driven by hydraulic cylinder 6 and piston 7, repetitively squeezes waste tossed into the cavity between strokes of the platen.

When the bale is complete and compressed by the platen, the operator threads wires through wireguides 8 (FIG. 1) in the bottom of the platen, down through wire guides 8' (FIG. 2) in the back wall, and out through wireguides 8" (FIG. 1 again) in the baler floor, and ties them. In a conventional baler, the platen rises, the compressed and wired bale is extracted, and the cycle is repeated.

In the Hazbaler, the conventional baler is modified to provide for loading the completed bale into a carton. The modifications comprise false sidewalls 10, which move vertically in guides (not shown) in sidewalls 1. The false sidewalls have latch-receivers, shown in this embodiment as holes; there are two latch-receivers in each false sidewall, positioned to receive latches mounted respectively on the platen (11) and on the sidewalls (11', FIG. 2). In this embodiment, the latches are represented by hydraulic cylinders 12 mounted on the platen, and 13 mounted on the sidewalls. In addition to the conventional wireguides 8 in the baler floor, back wall, and platen bottom, two additional wireguides 14 are provided on the top of the platen 5 for lifting wires. Wireguides 14' (FIG. 2) on the back of the baler are aligned with grooves 14 in the top of the platen and with grooves 14" in the baler floor. Means are provided in the back wall 2 of the baler for shoving the completed bale forward, as it hangs from the platen by the lifting wires, so that the bale will line up with the carton (this arrangement is described in detail below). In this embodiment the bale shoving means are hydraulic cylinders 16 and pads 15 (FIG. 2) mounted on the back wall of the baler. Pads 15 are shown in FIGS. 4 through 8 as phantom squares in the backwall of the Hazbaler.

Figure 3:
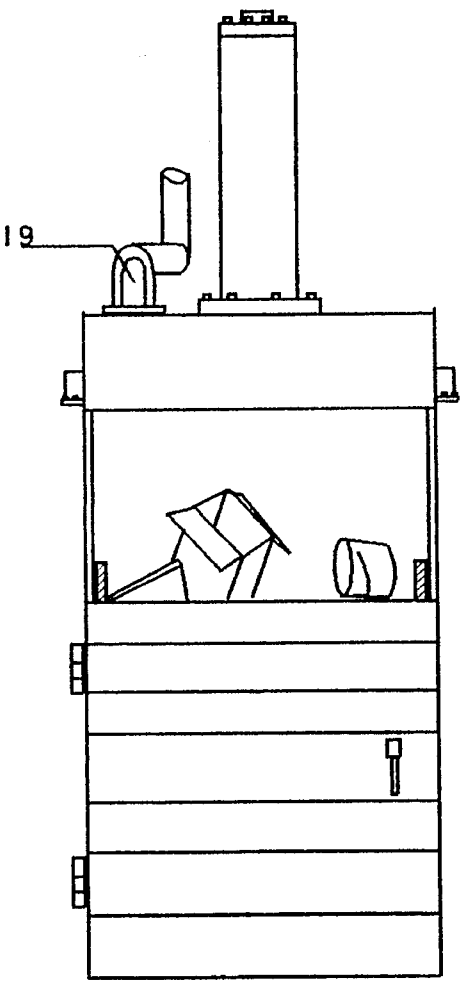
FIG. 3 is a front view of the Hazbaler fitted with an exhaust blower for maintaining air flow through the Hazbaler, so that noxious dust and vapors cannot escape into the local environment.

FIG. 3 is a view of the Hazbaler seen from in front. The Hazbaler is enclosed, except for the area above the door into which waste is loaded, in sheet metal. An exhaust fan 19 is mounted on the top of the Hazbaler. It is of a capacity to maintain a negative pressure inside the baler, so that any hazardous dust or vapors are drawn through the Hazbaler and exhausted by the fan.

FIGS. 4–8, cross-sections through the baler parallel with the front of the baler, illustrate the sequence of operation.

Figure 4:
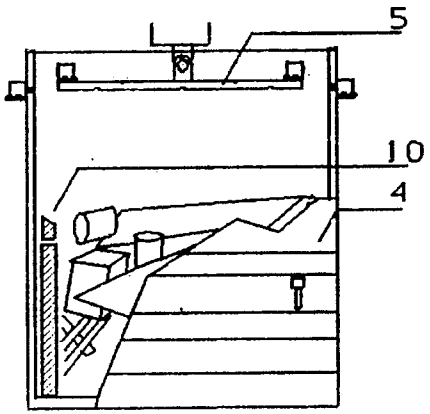

In FIG. 4, the bale is about to be formed. Door 4 is closed. False sidewalls 10, disengaged from the latches, rest on the baler floor, so that the bale will be of a length to fit into the carton. The operator tosses waste into the baler behind the door, repetitively causing platen 5 to squeeze the waste he has added, until the compressed waste has attained sufficient height to fill a carton. At that point, the platen will be lowered and the waste compressed, and the door will be opened.

Figure 5:
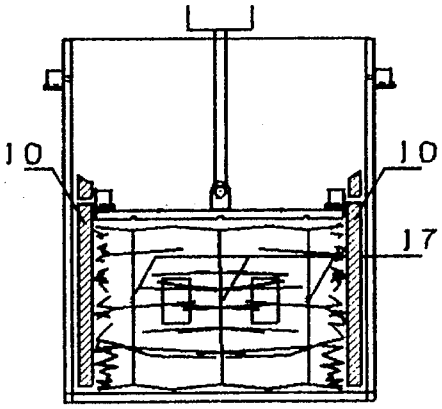

FIG. 5 shows the state of the baler after the operator has run his tie wires 17 around the bale through the tie-wire guides described above, and has tied them off, the door (not shown in this view) being open. False sidewalls 10 still rest on the floor of the baler.

Figure 6:
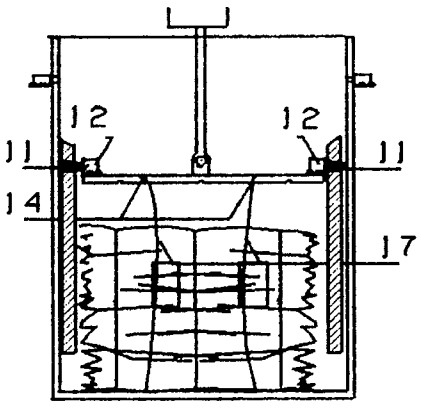
FIGS. 4 through 8 are cross sections of the hazardous waste baler showing sequential steps in its operation.

In FIG. 6, the operator has caused platen latches 12 to engage hole 11 in false sidewalls 10, and to rise a few inches above the tied bale, raising the false sidewalls with it. He has threaded lifting wires through grooves 14 in the top of the platen, down the back wall through grooves 14' (FIG. 1), and out through grooves 14" (FIG. 1) in the baler floor. He has tied the ends of the lifting wires.

Figure 7:
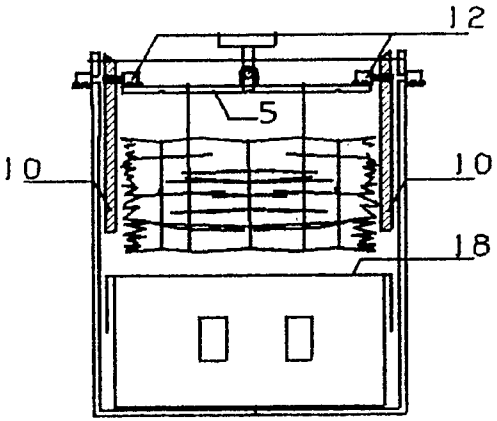

FIG. 7 shows the baler about to lower the bale into carton 18. The operator has caused the platen to rise high enough to allow him to position carton 18 beneath the bale; the false sidewalls 10, being latched to platen latches 12, have risen with the platen, leaving room at the sides for the carton to fit beneath the bale. Pusher plates 15 (FIGS. 1 and 2) have been activated by cylinders 16 (FIG. 2) in the back wall, shoving the bale slightly forward, providing clearance for the back wall of the carton positioned beneath it.

Figure 8:
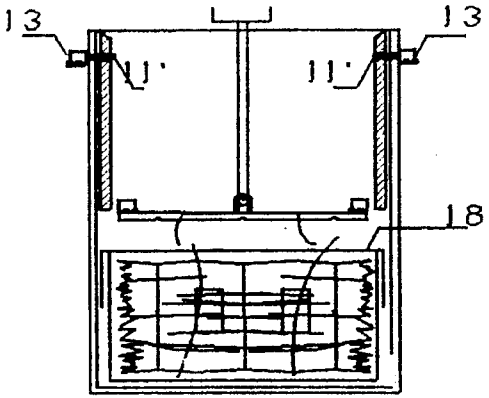

In FIG. 8, the bale has been lowered into carton 18. The operator has caused frame latches 13 to engage holes 11' on the false sidewalls (see FIG. 2), and platen latches 12 to disengage holes 11 (FIG. 2), so that false sidewalls 10 were suspended as the operator caused the platen to lower the bale into carton 18. He has cut the lifting wires, freeing the loaded carton from the platen.

In the next step, the operator will extract carton 18 with the bale in it, and will seal it as required with duct tape. Then he will cause the platen to rise again; platen latches 12 will engage the false sidewalls; frame latches 13 will disengage; the platen will descend, carrying the false sidewalls; platen latches 12 will disengage, leaving the false sidewalls in place in the bale chamber; and the platen will rise again, restoring the baler to the state illustrated in FIG. 1, ready for a new cycle.

In another embodiment, pusher plate 15 and cylinder 16 (FIG. 2) are not used. Instead, clearance for the back wall of the carton is provided by a false backwall attached at its edges to the false sidewalls 10, so that the whole assembly, false sidewalls and false backwall, rise as a unit when platen latches 12 engage latch receivers 11 in the false sidewalls 10.

The embodiments described above are exemplary of the invention only, and are not to be interpreted as limiting of the invention, the scope of which is as defined in the claims.

What is claimed is:

1. In a vertical baler having a back wall including a top, a floor and baler sidewalls each having atop and a lower part adjacent the floor, a door closeable against each of the lower parts of the baler sidewalls, a platen having a top and vertically movable between the baler sidewalls, a platform supported by the top of each of the baler sidewalls and back wall, and drive means mounted on the platform and connected to the platen for repetitively forcing the platen down against material deposited behind the door and between the baler sidewalls and back wall thereby compressing the material, the improvement comprising:

false sidewalls vertically moveable parallel to and adjacent the baler sidewalls;

latch-receiving means in the false sidewalls;

first latching means mounted on the platen and second latching means mounted on the baler sidewalls capable of engaging the latch-receiving means in the false sidewalls; and means for guiding lifting wires across the top of the platen, down the back wall, and across the floor of the baler.

2. The baler of claim 1 comprising the further improvement of means for urging the completed bale away from the back wall of the baler.

3. The baler of claim 1 comprising the further improvement of:

an enclosure around the baler having an aperture in it to enable loading of the baler with waste; and exhaust means connected to the enclosure to exhaust vapors from within the enclosure.

4. In a vertical baler having a bale chamber including side walls and a back wall in which a bale is made by multiple strokes of a platen moved by a drive means, the improvement comprising:

spacing means movable between a raised position out of the bale chamber and a lowered position within the bale chamber;

means on the platen for selectively engaging and disengaging the spacing means whereby the spacing means may be moved between the raised and lowered positions;

means on the side walls for retaining the spacing means in the raised position; and means for securing a completed bale to the platen while the bale is compressed.

5. The baler of claim 4 comprising the further improvement of means for urging the completed bale away from the back wall of the bale chamber.

6. The baler of claim 4 comprising the further improvement of:

an enclosure around the baler having an aperture in it to enable loading of the baler with waste; and exhaust means connected to the enclosure to exhaust vapors from within the enclosure.

* * * * *